US005847515A

United States Patent [19]

Lee et al.

[11] Patent Number: 5,847,515

[45] Date of Patent: Dec. 8, 1998

[54] FIELD EMISSION DISPLAY HAVING MULTIPLE BRIGHTNESS DISPLAY MODES

[75] Inventors: John K. Lee, Meridian; David A. Cathey, Boise, both of Id.

[73] Assignee: Micron Technology, Inc., Boise, Id.

[21] Appl. No.: 742,771

[22] Filed: Nov. 1, 1996

[51] Int. Cl.[6] ..... G09G 3/20

[52] U.S. Cl. ..... 315/169.1; 315/349; 345/74; 345/77

[58] Field of Search ..... 315/167, 169.1, 315/169.3, 349; 313/496, 497; 345/77, 74

[56] References Cited

U.S. PATENT DOCUMENTS

| | | | |
|---|---|---|---|
| 4,560,419 | 12/1985 | Bourassa et al. | 438/385 |
| 4,658,378 | 4/1987 | Bourassa | 365/154 |
| 4,908,539 | 3/1990 | Meyer | 315/169.3 |
| 4,940,916 | 7/1990 | Borel et al. | 313/306 |
| 5,103,144 | 4/1992 | Dunham | 315/366 |
| 5,157,309 | 10/1992 | Parker et al. | 315/169.1 |
| 5,162,704 | 11/1992 | Kobori et al. | 315/349 |
| 5,283,500 | 2/1994 | Kochanski | 315/58 |
| 5,357,172 | 10/1994 | Lee et al. | 315/167 |
| 5,387,844 | 2/1995 | Browning | 315/169.1 X |
| 5,396,150 | 3/1995 | Wu et al. | 313/495 |
| 5,410,218 | 4/1995 | Hush | 315/169.1 |
| 5,550,435 | 8/1996 | Kuriyama et al. | 315/169.1 |
| 5,581,159 | 12/1996 | Lee et al. | 315/167 |

OTHER PUBLICATIONS

Lee, Kon Jiun "Current Limiting of Field Emitter Array Cathodes," PhD thesis, Georgia Institute of Technology, Aug. 1986 pp. 1–5 and 157–162.

Benson, K. Blair, and Jerry C. Whitaker, *Television Engineering Handbook,* McGraw–Hill, Inc., New York, 1992, Chap. 4, "Monochrome and Color Visual Information Transmission," pp. 4.19–4.20.

*Primary Examiner*—Robert J. Pascal
*Assistant Examiner*—Justin P. Bettendorf
*Attorney, Agent, or Firm*—Seed and Berry LLP

[57] ABSTRACT

A field emission display includes a display screen and a cathodoluminescent coating disposed on a conductive inner surface of the display screen. An extraction grid is disposed a predetermined distance away from the inner surface and has a plurality of openings. A plurality of emitters are each aligned with a corresponding one of the openings and are arranged in sets that include at least one emitter. A plurality of emitter driver circuits are each coupled to the emitters in a corresponding one of the sets. Each of the driver circuits receives a control signal having first and second values. The drive circuits drive the emitters such that the display screen displays an image having a first brightness level when the control signal has the first value, and drives the emitters such that the display screen displays an image having a second brightness level when the control signal has the second value. The ratio of the second brightness level to the first brightness level is significantly greater than the ratio of the second value of the control signal to the first value. In one aspect of the invention, each of the driver circuits includes an impedance element that has a nonlinear current-voltage characteristic to give the described ratios.

30 Claims, 5 Drawing Sheets

FIELD EMISSION DISPLAY HAVING MULTIPLE BRIGHTNESS DISPLAY MODES

STATEMENT AS TO GOVERNMENT RIGHTS

This invention was made with Government support under Contract No. DABT 63-93-C-0025 awarded by Advanced Research Projects Agency (ARPA). The Government has certain rights in this invention.

TECHNICAL FIELD

The present invention relates generally to semiconductor devices, and more specifically to a field emission display (FED) having two or more display modes, such as a lower-brightness direct-view mode and a higher-brightness projection mode.

BACKGROUND OF THE INVENTION

An FED is a type of flat-panel display that engineers have developed to replace the cathode ray tube (CRT) display. Typically, an FED includes a plurality of cathode emitters that can emit electrons while "cold," i.e., not heated like the cathode coil of a CRT. The emitted electrons are attracted to an anode which is coated with a cathodoluminescent material. The anode is formed by a transparent conductive material coating a transparent display screen. The electrons from each emitter collide with the screen at a corresponding location or point. Each collision point forms all or part of a picture element, i.e., pixel, of a displayed image. The greater the collision rate at a particular pixel, the brighter the pixel appears. Likewise, the lower the collision rate, the dimmer the pixel appears. Furthermore, the rate at which an emitter emits electrons, and hence the collision rate at a particular pixel, is directly proportional to the current supplied to the emitter. Therefore, the greater the emitter current, the brighter the pixel.

FIG. 1 is a cross-sectional view of a portion of a conventional FED 10, which includes a conductive region 12 and an emitter 18 formed in electrical contact with the region 12. Emitter sets each having multiple emitters 18 are typically provided for each pixel to ensure that the pixel will remain functional if one or more of the emitters 18 become defective. However, because the total electron flow per pixel is maintained at a substantially constant level, a change in the number of emitters 18 per pixel has little or no effect on the brightness of the pixel. For clarity, only one emitter 18 is shown in FIG. 1.

The emitter 18 is surrounded by a cavity, i.e., opening 20, which is formed in an insulator 22 and in an overlying conductive extraction grid 24. A display screen 30 includes a glass layer 32 having disposed on its inner surface a transparent and conductive indium tin oxide (ITO) layer that forms an anode 34, and a cathodoluminescent coating 36. A voltage source 38 biases the extraction grid 24 at a first positive voltage with respect to the conductive region 12, and biases the anode 34 at a second positive voltage that is higher than the first positive voltage. For example, the grid 24 is often biased to 30–110 volts (V), and the anode 34 is often biased to 1–2 kilovolts (kV) with respect to the conductive region 12.

In operation, when a sufficiently positive voltage is applied to the extraction grid 24, the emitter 18 emits electrons so that current flows from the emitter 18 through the conductive region 12. The voltage applied to the anode 34 accelerates these electrons toward the cathodoluminescent coating 36. As the electrons strike the cathodoluminescent coating 36, light is emitted to form all or part of the pixel of the image that is displayed on the screen 30. For a color screen 30, different cathodoluminescent coatings 36 are typically arranged to emit the appropriate combinations of colored light so as to create a color display image.

The structure and operation of conventional FEDs, such as FED 10, are further discussed in U.S. Pat. No. 5,186,670, to Doan et al., and U.S. Pat. No. 5,357,172, to Lee et al., which are incorporated by reference herein.

FIG. 2 is a schematic diagram of a conventional passive-matrix FED 40. The FED 40 includes rows 42*a*–42*c* of extraction girds and columns 46*a*–46*c* of emitters 44. When respective appropriate voltages are applied to a row 42*a*–42*c* and column 46*a*–46*c*, electrons are emitted from the emitters 44 in the column 46*a*–46*c* that intersects the driver row 42*a*–42*c*. Only three columns and rows 42 and 46 are shown for clarity, it being understood that the FED 40 typically has more rows and columns. Furthermore, although shown to include four emitters 44, each emitter set may contain fewer or more emitters 44.

The row signals driving the extraction grids are provided by a shift register 48 that receives a horizontal synchronization signal that is stripped from an incoming video signal, and sequentially activates buffers 50*a*–50*c*, each of which when activated provides a grid voltage from a grid voltage generator 52 to the associated extraction grid 42*a*–42*c*. Circuits 54*a*–54*c* provide respective emitter drive currents, which are proportional to the luminance signals La–c, to the columns 46*a*–46*c*. A video processing circuit (not shown in FIG. 2) generates the luminance signals La-c from the video signal.

FIG. 3 is a schematic diagram of a portion of a conventional active-matrix FED 60. For clarity, only a portion of the FED 60 that corresponds to one group of emitters 62 is shown. A pair of NMOS transistors 64 and 66 and a resistor R are serially coupled between the emitters 62 and a reference voltage, here ground, to form an emitter drive circuit 67. Furthermore, FED 60 has one continuous extraction grid 68, which is typically always active when the FED 60 is in use.

In operation, to activate the emitters 62, an active level (typically 5 V) of an enable signal E is applied to the gate of transistor 64 such that the transistor 64 acts as a closed switch. A luminance signal L is applied to the gate of the transistor 66, which generates across the resistor R a voltage Vr=L−Vgs, where Vgs is the gate-to-source voltage of the transistor 66. Vr causes a current Ir=Vr/R to flow through both the resistor R and the emitters 62. Thus, the value of R and the voltage range of L can be selected to give a displayed image having a desired range of brightness. The drive circuit 67 and circuits similar thereto are also suitable for use as circuits 54*a*–54*c* of FIG. 2, even though the FED 40 is a passive-matrix display.

In some video devices, it may be desirable to have an FED display an image in two or more modes where the brightness level of the image is different for each mode. The brightness level of an image is equal to the sum of the brightness levels of each pixel that composes the image. The different display modes may be defined by the average brightness level of a displayed image. The average brightness level is equal to the sum of the brightness levels of each pixel divided by the total number of pixels. The display modes may also be defined by the maximum brightness level of a displayed image, which is equal to the brightness level of the image where all the pixels are at maximum brightness. Because it is independent of the particular image or scene being displayed, the maximum brightness level is hereinafter used to differentiate between different display modes, it being understood that other measures of the brightness level, such as the average brightness level, may be used to differentiate between different display modes.

One possible technique for providing an FED that can display an image in two or more brightness modes is to provide two or more ranges of voltage values for the luminance signal L.

A problem with this approach is that the desired brightness difference between display modes may require values for L that the FED cannot tolerate. For example, in both the passive and active-matrix FEDs 40 and 60 of FIGS. 2 and 3, respectively, the current through the emitters, and thus the brightness of the displayed image, is linearly proportional to the luminance signal L. That is, if one wishes to increase the maximum brightness of the displayed image by a factor of K, then one must increase the maximum value of the luminance signal L by approximately a factor of K as well. Because the design of most conventional FEDs, such as FEDs 40 and 60, limits the maximum value of L to approximately 5 V, it is very difficult, if not impossible, to increase the maximum brightness level of an image by any significant amount. For example, if FED 40 or 60 were designed such that a displayed image had a maximum brightness level when L=Lmax=2.5 V, increasing Lmax to 5 V would merely double the maximum brightness level. However, many applications require different brightness modes having maximum brightness levels that differ by more than a factor of 2. Suppose it is desired that the maximum brightness level of a first display mode be 10–20 times greater than that of a second display mode. Thus, if Lmax=2.5 V for the second mode, then for the first mode Lmax would have to fall within a range of 25 V–50 V, which is approximately 5–10 times greater than the 5 V maximum tolerable voltage for L.

SUMMARY OF THE INVENTION

In one aspect of the invention, a field emission display includes a display screen and a cathodoluminescent coating disposed on an inner surface of the display screen. A conductive extraction grid is disposed a predetermined distance away from the inner surface and has a plurality of openings. A plurality of emitters are each aligned with a corresponding one of the openings and are preferably arranged in sets that include one or more emitters. A plurality of emitter driver circuits are each coupled to the emitters in a corresponding one of the sets. Each of the driver circuits receives a control signal having first and second values. The drive circuits drive the emitters such that the display screen displays an image having a first brightness level when the control signal has the first value, and drives the emitters such that the display screen displays an image having a second brightness level when the control signal has the second value. The ratio of the second brightness level to the first brightness level is significantly greater than the ratio of the second value of the control signal to the first value.

In a related aspect of the invention, the control signal provides first and second voltages, and each of the driver circuits include an impedance element that has a nonlinear current-voltage characteristic. Each of the driver circuits couples the first voltage across the impedance element to generate a first current and drives the emitters with the first current such that the screen displays the image having the first brightness. Each of the drivers also couples the second voltage across the impedance element to generate a second current, and drives the emitters with the second current such that the screen displays the image having the second brightness.

An advantage provided by the invention is a first display mode having a brightness level that is related to the brightness level of a normal display mode by a first factor, wherein the luminance-signal levels for each of the respective modes are related by a second factor that is significantly less than the first factor. That is, the gains of the driver circuits are nonlinear, such that a relatively small increase in the value of the luminance signal generates a relatively large increase in the brightness level of the displayed image. Thus, relatively high brightness levels can be generated using tolerable levels for the luminance signal.

DETAILED DESCRIPTION OF THE INVENTION

Figure 4:
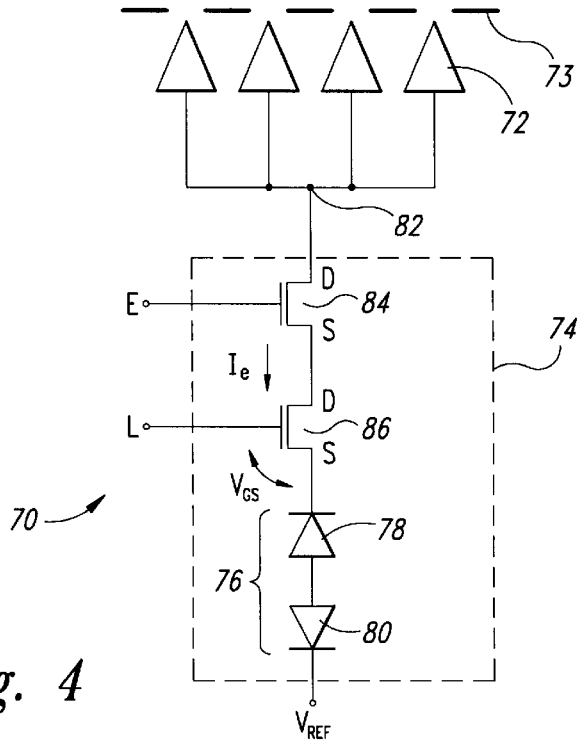
FIG. 4 is a schematic diagram of a portion of an active-matrix FED according to the present invention.

FIG. 4 is a schematic diagram of a portion of an active-matrix FED 70 according to the present invention. The FED 70 includes an extraction grid 73, and for each group of emitters 72, includes an emitter driver, i.e., current generator, 74, which generates and provides a drive current to the emitters 72. In accordance with one embodiment of the invention, the current generator 74 includes an impedance element 76 that has a nonlinear current-voltage characteristic. Here, the nonlinear impedance element 76 is formed from back-to-back coupled diodes 78 and 80, it being understood that other nonlinear impedance elements may be used. For example, the diode 80 may be omitted such that the impedance element 76 includes only the reverse-biased diode 78, which by itself provides the nonlinear current-voltage characteristic. For clarity, only the back-to-back diode structure is discussed in detail, it being understood that the reverse-biased diode structure operates and can be formed in a similar manner. The nonlinear impedance element 76 is coupled to a common node 82 of the emitters 72 via a pair of serially coupled NMOS transistors 84 and 86. The remaining terminal of the impedance element 76 is coupled to a voltage Vref, which in one aspect of the invention is ground.

In operation, to activate the group of emitters 72, and hence the pixel associated therewith, an active level for the enable signal E, which in one aspect of the invention is approximately 5 V, drives the gate of the transistor 84 such that the transistor 84 acts as a closed switch. The luminance signal L drives the gate of the transistor 86, which generates across the nonlinear impedance element 76 a voltage Vr=L−Vgs−Vref. The voltage Vr allows a current Ie to flow through the nonlinear impedance element 76, and thus through the emitters 72.

The nonlinear impedance element 76 is designed such that an increase in L by a factor of K causes an increase in Ie by a factor of KY, where Y is greater than, and often considerably greater than, 1. Such an impedance element 76 is useful to allow the FED 70 to have multiple display modes. Examples of devices in which it may be desirable to have multiple display modes include a video camera having the FED 70, which can display an image both in a lower-brightness direct-view mode and in a higher-brightness projection mode. In the direct-view mode, an operator (not shown) views the FED 70 directly, typically through conventional viewing optics such as a view finder (not shown in FIG. 4). In the projection mode, the FED 70 projects the image onto a remote projection screen (not shown) via conventional projection optics (not shown in FIG. 4), and the operator views the image on the remote screen. To provide optimum viewing conditions in both modes, the maximum brightness of an image that is displayed in the direct-view mode should be significantly less than the maximum brightness of an image that is displayed in the projection mode. For example, one may wish that the projection mode have a maximum brightness level that is approximately 20 times that of the viewing mode. If Lmaxv=2.5 V provides the maximum viewing-mode current Iemaxv and, hence, the maximum brightness level of the viewing mode, then one can design the nonlinear impedance element 76 such that Lmaxp=5 V provides the maximum projection-mode current Iemaxp≈20(Iemaxv), and thus provides a maximum brightness level for the projection mode that is approximately 20 times that of the maximum brightness level of the viewing mode. In this example, X=2 and Y=10. That is, for an increase in Lmaxv by a factor of 2, the maximum brightness level of the displayed image in the projection mode increases by a factor of approximately 10×2=20.

Figure 5:
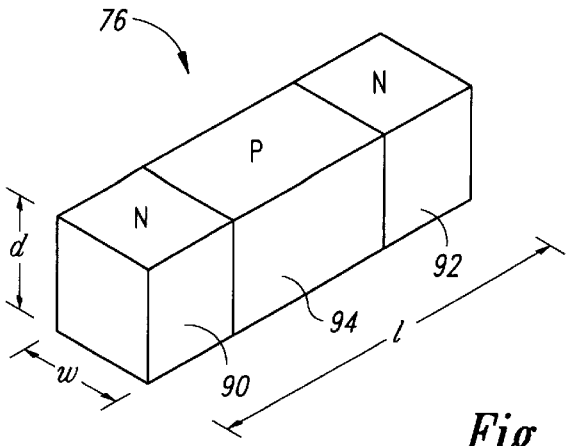
FIG. 5 is an isometric view of a nonlinear impedance element according to the present invention.

FIG. 5 is an isometric view of one embodiment of the nonlinear impedance element 76 of FIG. 4. The impedance element 76 is typically formed from polysilicon, although it may be formed from either microcrystalline silicon or amorphous silicon, and has a length l, a depth d, and a width w. The impedance element 76 includes two end sections 90 and 92, which are integrally formed with a midsection 94 to form a back-to-back diode structure. In a preferred embodiment of the invention, the two end sections 90 and 92 are doped N-type and the midsection 94 is doped P-type, although in other embodiments of the invention, the end sections 90 and 92 are doped P-type and the midsection 94 is doped N-type. The impedance of the element 76 depends primarily on the areas w×d of the junctions of the end sections 90 and 92 with the midsection 94.

Figure 6:
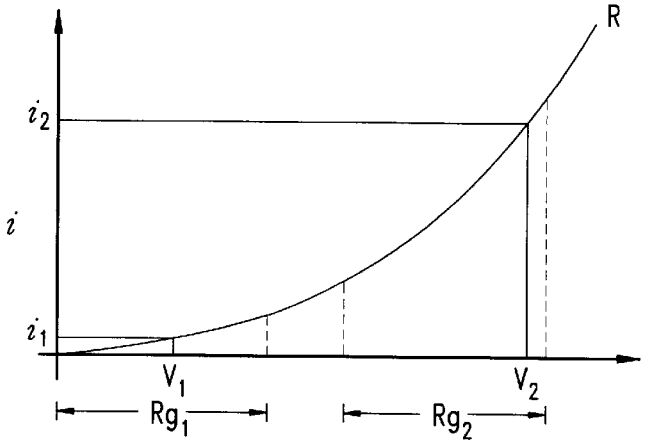
FIG. 6 is a plot of the current-voltage characteristic of the nonlinear impedance element of FIG. 5.

FIG. 6 is a graph that shows generally the nonlinear current-voltage, i.e., I-V or resistance R, characteristic of the impedance element 76. That is, the graph plots the value of current that flows through the nonlinear impedance element 76 for a given voltage that is applied across the impedance element 76. For example, referring to the voltage values $V_1$ and $V_2$, and the current values $I_1$ and $I_2$, one can see that $V_2 \approx KV_1$ and $I_2 \approx KYI_1$. Thus, for an increase in $V_1$, by a factor of K, $I_1$ increases by a factor of KY. In this example, K≈4, KY≈15, and thus Y≈3.75. Thus, $$I_2/I_1 = \frac{\text{display brightness for } I_2}{\text{display brightness for } I_1} \approx 15$$

is significantly greater than $V_2/V_1 \approx 4$. As further discussed below in conjunction with Tables 1 and 2, by changing the doping and dimensions of the impedance element 76, one can form the element 76 having a desired I-V characteristic.

In addition to providing a generally nonlinear impedance between arbitrarily chosen values of voltage or current, one can form the element 76 such that its I-V characteristic can be divided into two ranges, Rg1 and Rg2. Within each range, the resistance R of the element 76 is approximately linear. However, the slope of R is substantially greater within the range Rg2 than within the range Rg1. This means that within the range Rg1, increasing the voltage V by a factor K increases the current I by a factor $Y_1$, and within range Rg2, an increase in V by the same factor K will increase I by a factor of Y2, which is significantly greater than Y1. Hence, the nonlinear impedance element 76 provides the emitter driver 74 (FIG. 4) with a first approximate linear gain of $Ie/L_{Rg1}$ when operated within the range Rg1, and with a second approximate linear gain $Ie/L_{Rg2}$ when operated within the range Rg2, the second gain being substantially higher than the first gain.

Referring to FIGS. 5 and 6, Tables 1 and 2 show voltage and current values for two embodiments of the impedance element 76 of FIG. 5. he embodiment of the impedance element 76 described in Table 1 has d=5,000 Å, w=2 microns (μm), and l=20 μm. The embodiment of the impedance element 76 described in Table 2 has d=5,000 Å, w=5 μm, and l=10 μm. In both embodiments, the impedance element 76 is formed from polysilicon, the N-type end sections 90 and 92 are doped with approximately $8.5\times10^{15}$ atoms/cm$^2$ of phosphorous, and the P-type midsection 94 is doped with approximately $9.0\times10^{14}$ atoms/cm$^2$ of boron. The implant energy for the doping of sections 90, 92, and 94 has a value that is within the range of 35–60 kev, although it may be higher in other embodiments of the invention.

TABLE 1

Current-Voltage Characteristic of the First Embodiment of the Impedance Element 76

| V(Volts) | 1 | 2 | 3 | 4 | 5 |
|---|---|---|---|---|---|
| R(Gohms) | 30.7 | 14.8 | 4.70 | 1.54 | 0.524 |
| I(Nanoamps-nA) | .0326 | .135 | .638 | 2.60 | 9.54 |

TABLE 2

Current-Voltage Characteristic of the Second Embodiment of the Impedance Element 76

| V(Volts) | 1 | 2 | 3 | 4 | 5 |
|---|---|---|---|---|---|
| R(Gohms) | 18.7 | 7.38 | 2.65 | 0.938 | 0.320 |
| I(nA) | .0534 | .271 | 1.13 | 4.26 | 15.6 |

Impedance elements similar to the impedance element 76 and techniques for forming such impedance elements are further discussed in U.S. patent application Ser. No. 08/554,853, now U.S. Pat. No. 5,581,159 filed Nov. 7, 1995, entitled "Back-To-Back Diode Current Regulator for Field Emission Display."

Referring to FIGS. 4–6, to further illustrate the inventive concepts, the viewing modes of the FED 70 are discussed. For example purposes, suppose that the FED 70 has an aspect ratio of 4:3, a diagonal of 0.55 inches, and a total of 100,000 pixels. In a desired viewing mode, suppose that the maximum brightness of the displayed image is approximately 40 foot-lamberts (ft-lb), and at this brightness level, the phosphor efficiency of the FED 70 is approximately 1 ft-lb/microamp ($\mu$A). At the maximum brightness level, the combined currents to all of the emitters total 40 $\mu$A, which corresponds to approximately 400 picoamps ($\mu$A) per pixel. Furthermore, the FED 70 generates a small amount of luminance even when no current flows through the emitters. This luminance, often called background brightness, is equivalent to a total tip current of approximately 0.4 $\mu$A, which corresponds to 4 pA per pixel, for an ideal FED 70 that generates zero luminance when no current flows through the emitters. Thus, the maximum brightness current of 400 pA per pixel divided by the minimum brightness, which equals the background brightness of 4 pA per pixel, gives a contrast ratio of approximately 100:1. Using the impedance element 76 having the characteristics shown in Table 1, such a viewing mode can be realized with a luminance signal L having a values that range from approximately 0 V–2.7 V.

In a desired projection mode, suppose that the maximum brightness of the image that the FED 70 displays is approximately 1000 ft-lb. Ideally, the phosphor efficiency of the FED 70 will remain at 1 ft-lb/$\mu$A, although nonlinear characteristics and the phosphorus may cause the phosphor efficiency to vary from this value. The value of 1,000 ft-lb for the maximum projection-mode brightness corresponds to a total tip current of approximately 1 milliamp (mA), which corresponds to approximately 10 nA per pixel. It is often desired to maintain the same contrast ratio in both the viewing and projection modes. Therefore, to maintain a 100:1 contrast ratio in the projection mode, the minimum brightness is raised to the desired level by providing a total base current of approximately 96 pA per pixel to the FED 70. Such a base current raises the minimum brightness to a level that is equivalent to approximately 96 pA (actual current)+4 pA (equivalent background current)=100 pA per $$\frac{10\text{ nA per pixel}}{100\text{ pA per pixel}} = 100{:}1$$

contrast ratio. Using the impedance element 76 having the characteristics shown in Table 1, the projection mode can be realized using a luminance signal L having values that range from approximately 1.5 V–5 V.

Figure 1:
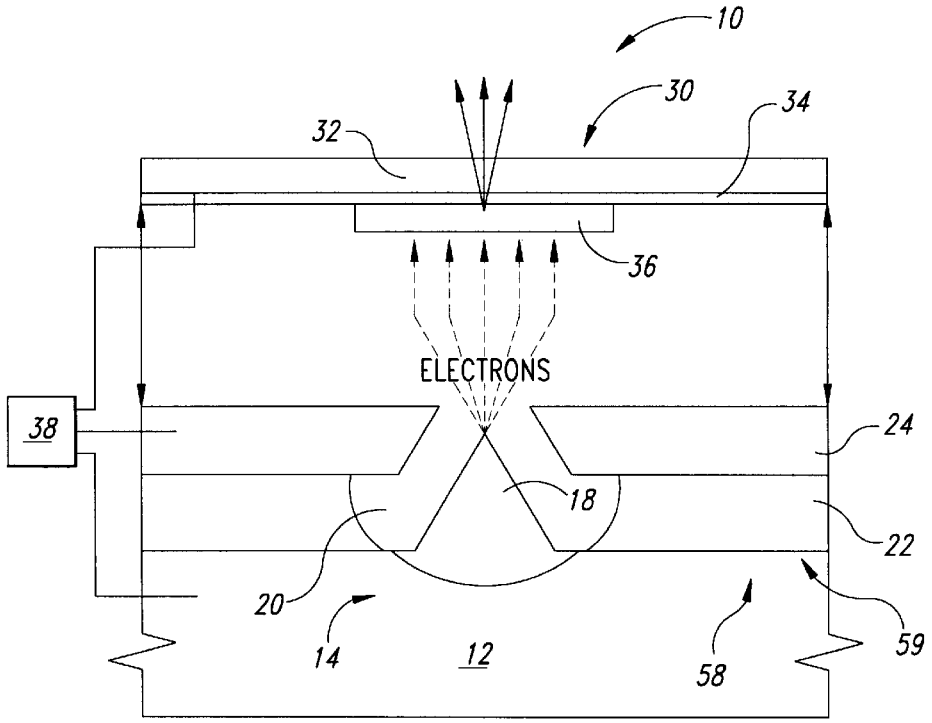
Fig. 1 (Prior Art)
FIG. 1 is a cut-away side view of a portion of a known FED.

In the above-described example embodiment of the FED 70, the display screen 30 has a conventional coating 36 (FIG. 1) that has both a saturation threshold that is high enough to support the projection mode and an efficiency that is high enough to provide the lower brightness levels in the viewing mode.

Figure 7:
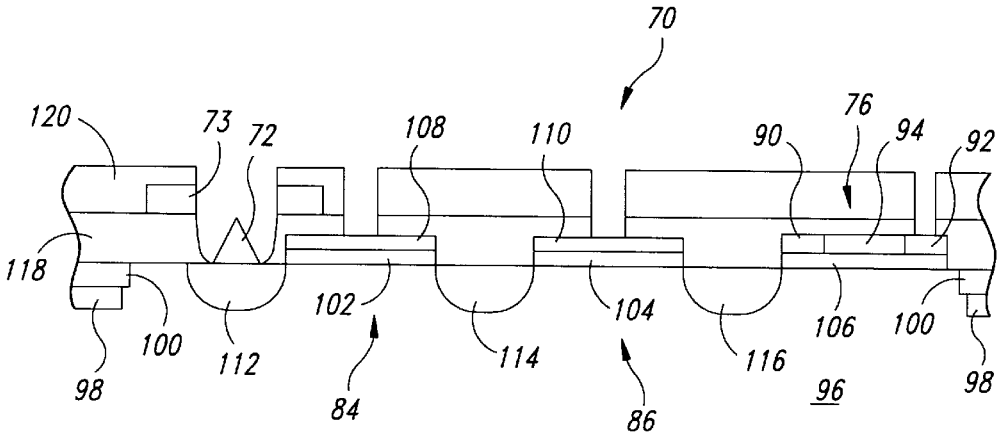
FIG. 7 is a cross-sectional view of a portion the active-matrix FEDofFigure4.

FIG. 7 is a cross-sectional view of a portion of one embodiment of the active-matrix FED 70 of FIG. 4. Field-oxide regions 100 and P-type isolation regions 98 are formed in a P-type substrate 96. For example, the fiel-doxide regions 100 may be formed using the well-known LOCOS process, and the isolation regions 98 may be formed either before or after the regions 100. Next, an insulating layer is formed and etched to form gate insulators 102 and 104 and insulator 106. A conductive layer such as polysilicon is then deposited and etched to form the gate electrodes 108 and 110 and the impedance element 76. Next, the drain and source regions 112, 114, and 116, and the regions 90, 92 and 94 of the impedance element 76 are formed by impurity implantation. The emitter 72 may be formed prior to the LOCOS process, or may be formed after LOCOS but before the process steps during which the gates 108 and 110 and the impedance element 76 are formed. A second insulating layer 118, the conductive grid 73, and a passivation layer 120 are then formed, and the layers 120 and 118 as well as the extraction grid 73 are etched to expose the emitter 72 and to form the contact openings to the gates 108 and 110 and to the impedance element 76. Alternatively, the impedance element 76 may be formed during the formation of and in the same layer as the grid 73.

The above-described embodiment of the FED 70 may be formed using conventional processes. Alternatively, the FED 70 may be formed as described in U.S. patent application Ser. No. 08/554,551, filed Nov. 6, 1995, entitled "Cold-Cathode Emitter and Method for Forming the Same," which is incorporated by reference herein.

Figure 8A:
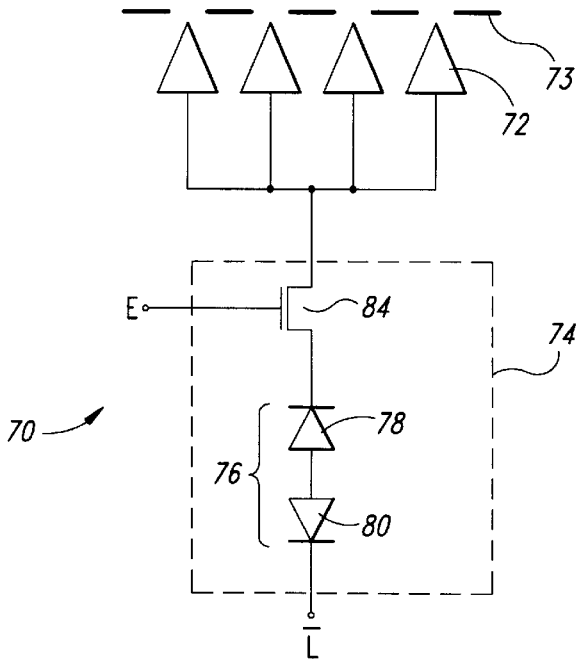
FIG. 8A is a schematic diagram of a second embodiment of the emitter-tip driver of FIG. 4.

FIG. 8A is a schematic diagram of a second embodiment of the current generator 74 of FIG. 4. In this embodiment, the transistor 86 is omitted, and $\overline{L}$, the complement of the luminance signal L, is coupled directly to a terminal of the impedance element 76.

In operation, the enable signal E drives the gate of the transistor 84 to activate a selected set of the emitters 72. The current through the nonlinear impedance element 76 and emitters 72, and thus the brightness of the corresponding pixel, is proportional to the value of $\overline{L}$.

Figure 8B:
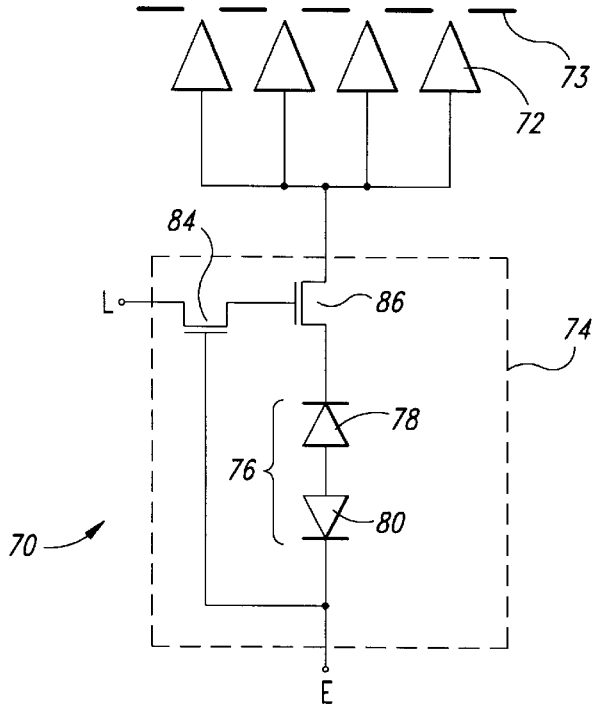
FIG. 8B is a schematic diagram of a third embodiment of the emitter-tip driver of FIG. 4.

FIG. 8B is a schematic diagram of a third embodiment of the current generator 74 of FIG. 4. In this embodiment, the enable signal E is coupled directly to a terminal of the impedance element 76 and to the gate of the transistor 84, which is serially coupled between the luminance signal L and the gate of the transistor 86.

In operation, to set the current level of the generator 74, E is driven to an active high level to close the switch formed by the transistor 84, which couples L to the gate of the transistor 86. Next, E is driven to an inactive low level to uncouple L from the transistor 86. However, the gate capacitance of the transistor 86 stores the value of L for a predetermined time such that in a manner similar to that described above in conjunction with FIG. 4, a voltage equal to Vr=L−Vgs appears across the impedance element 76, and thus sets the current that flows through the element 76 and the emitters 72. Therefore, such a current generator 74 is suited for applications where it is desired that the emitters 72 are essentially always on, i.e., have a duty cycle that is approximately 100%, and are periodically updated with new luminance values.

Figure 8C:
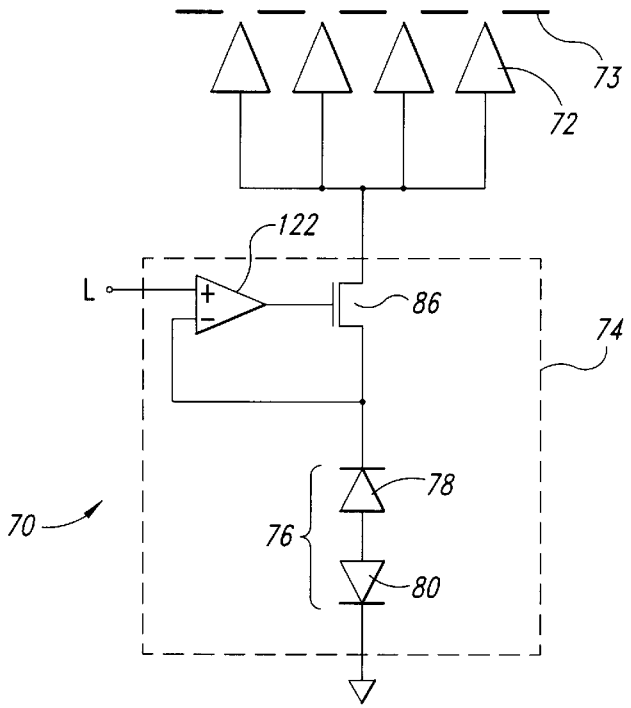
FIG. 8C is a schematic diagram of a fourth embodiment of the emitter-tip driver of FIG. 4.

FIG. 8C is a schematic diagram of a fourth embodiment of the current generator 74 of FIG. 4. This embodiment lacks the transistor 84 and does not receive the enable signal E, but includes a high-gain differential amplifier 122, such as an operational amplifier, which is coupled in a negative-feedback voltage follower configuration.

In operation, the amplifier 122 receives L at the noninverting (+) input terminal, and controls the voltage at the gate of the transistor 86 such that the voltage fed back to the inverting (−) input terminal, and thus the voltage across the nonlinear impedance element 76, is substantially equal to L. Thus, unlike the previous embodiments of the generator 74 where the voltage Vr across the element 76 equals L−Vgs, in this embodiment L appears across the element 76. An advantage of this embodiment is that the designer can predict the generated emitter current more accurately, because the amplifier 122 provides L across the element 76 regardless of Vgs and the other characteristics of the transistor 86.

Figure 2:
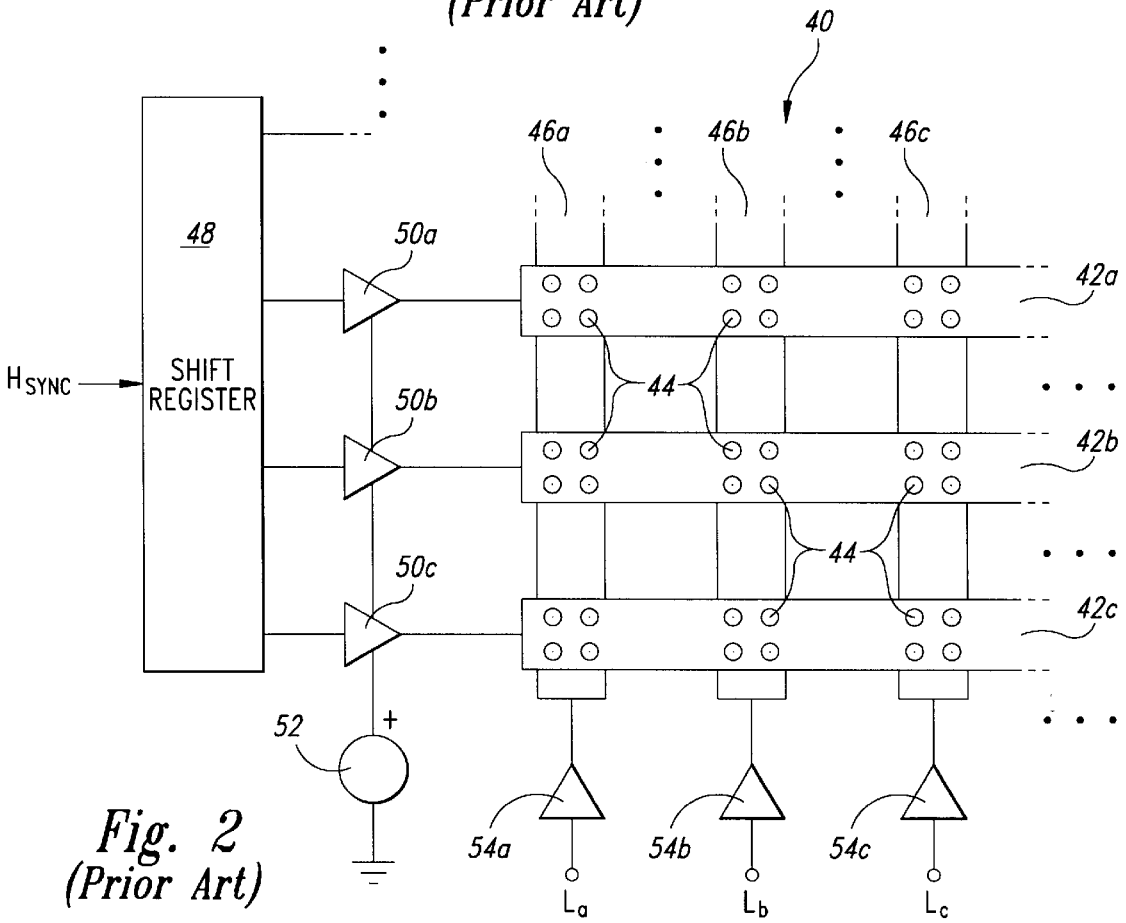
Fig. 2 (Prior Art)
FIG. 2 is a schematic diagram of a known passive-matrix FED.
Figure 3:
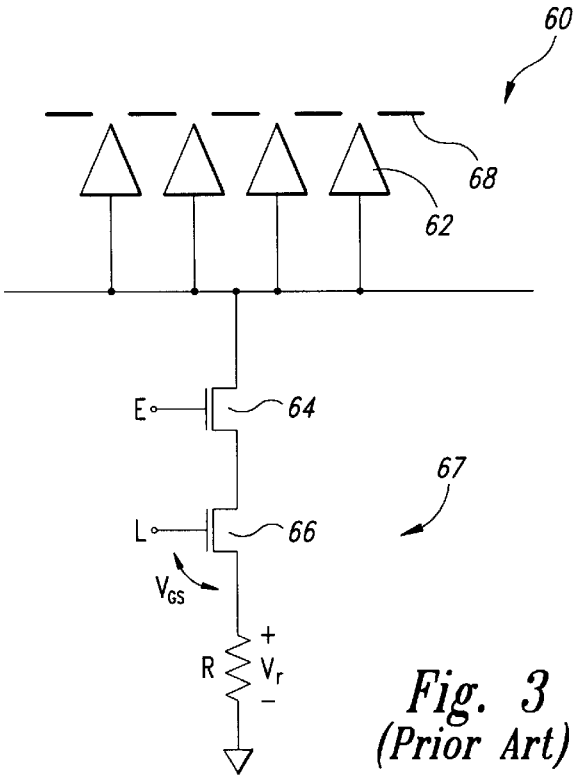
Fig. 3 (Prior Art)
FIG. 3 is a schematic diagram of a portion of a known active-matrix FED.
Figure 8D:
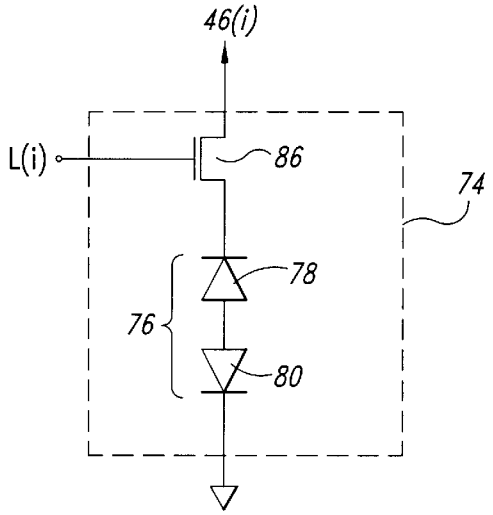
FIG. 8D is a schematic diagram of an emitter-tip driver that is suitable for use with the passive-matrix FED of FIG. 2.

FIG. 8D is an embodiment of the current generator 74 that is suitable for use with the passive-matrix display 40 of FIG. 2. The current generator 74 is structured and operates similarly to that shown in FIG. 4, except that the transistor 84 is omitted.

Figure 9:
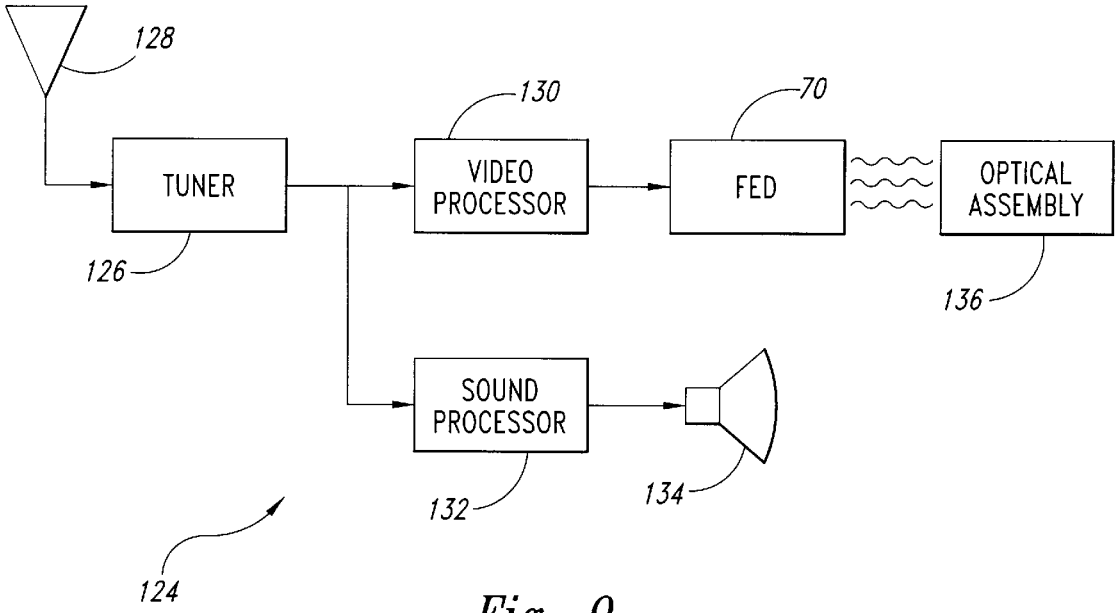
FIG. 9 is a video receiver and display unit that incorporates the present invention.

FIG. 9 is a block diagram of a video receiver and display device 124 that incorporates the FED 70 of FIG. 4. The device 124 includes a conventional tuner 126 that receives one or more broadcast video signals from a conventional signal source such as an antenna 128. An operator (not shown) programs, or otherwise controls, the tuner 126 to select one of these broadcast signals and to output the selected broadcast signal as a video signal. The tuner 126 may generate the video signal at the same carrier frequency as the selected broadcast signal, at a base band frequency, or at an intermediate frequency, depending upon the design of the device 124.

The tuner 126 couples the video signal to a conventional video processor 130 and a conventional sound processor 132. The sound processor 132 decodes the sound component of the video signal and provides the sound signal to a speaker 134, which converts the sound signal into audible tones. The video processor 130 decodes, or otherwise processes, the video component of the video signal and generates a display signal. The video processor 130 may generate the display signal as either a digital or an analog signal, depending upon the design of the device 124.

The video processor 130 couples the display signal to the FED 70, which converts the display signal into a visible image. A conventional optical assembly 136 is located a predetermined distance away from the display screen of the FED 70, and allows direct viewing of the image in the view mode, and projection of the image in the projection mode.

In one aspect of the invention, the sound processor 132 and the speaker 134 are omitted such that the device 124 provides only a video image. Furthermore, although shown coupled to the antenna 128, the tuner 126 may receive broadcast signals from other conventional sources, such as a cable system or a satellite system, and the video processor 130 may receive a video signal from a source other than a tuner 126, such as a video cassette recorder (VCR). Alternatively, the tuner 126 may receive a nonbroadcast video signal, such as from a closed circuit video system. In such a case where only one video signal is input to the device 124, the tuner 126 may be omitted and the video signal may be directly coupled to the inputs of the video processor 130 and the sound processor 132.

From the foregoing it will be appreciated that, although specific embodiments of the invention have been described herein for purposes of illustration, various modifications may be made without deviating from the spirit and scope of the invention. For example, although an FED having direct-view and projection modes is discussed, FEDs having more than two brightness modes may be formed in accordance with the present invention. Furthermore, although described with reference to the active-matrix FED 70 of FIG. 4, a passive-matrix FED, which may be similar to the FED 40 of FIG. 2, can be formed in accordance with the present invention to display images in multiple display modes. Accordingly, the invention is not limited except as by the appended claims.

We claim:

1. A field emission display, comprising:

a display screen having a conductive inner surface;

a cathodoluminescent coating disposed on said inner surface;

an extraction grid in spaced relation to said inner surface, said grid having a plurality of openings;

a plurality of emitters each aligned with a corresponding one of said openings, said emitters arranged in sets that each include at least one emitter; and a plurality of emitter drivers each coupled to the emitters in a corresponding one of said sets, each of said drivers connected to receive a control signal having first and second ranges of values, said drivers driving said emitters such that said display screen displays a first image in a first brightness mode when said control signal is within said first range of values, said drivers driving said emitters such that said display screen displays a second image in a second brightness mode when said control signal is within said second range of values, the ratio of the maximum brightness of said first image in said first brightness mode to the maximum brightness of said second image in said second brightness mode being significantly greater than the ratio of the maximum value of said second range of values to the maximum value of said first range of values.

2. The field emission display of claim 1 wherein:

said first and second ranges of values of said control signal respectively comprise first and second ranges of voltages; and each of said drivers converts said first range of voltages into a first range of currents and said second range of voltages into a second range of currents, and each of said drivers drives the emitters in said corresponding group of emitters with said first and second ranges of currents such that when said drivers drive said emitters with a current within said first range of currents, said screen displays said first image in said first brightness mode, and when said drivers drive said emitters with a current within said second range of currents, said screen displays said second image in said second brightness mode.

3. the field emission display of claim 1 wherein:

said first and second ranges of values of said control signal respectively comprise first and second ranges of voltages; and each of said drivers comprises an impedance element having a nonlinear current-voltage characteristic, each of said drivers couples said first and second ranges of voltages across said impedance element to generate first and second ranges of currents respectively, and each of said drivers drives the emitters in said corresponding group of emitters with respective currents within said first and second ranges of currents such that when said drivers drive said emitters with a current within said first range of currents, said screen displays said first image in said first brightness mode, and when said drivers drive said emitters with a current within said second range of currents, said screen displays said second image in said second brightness mode.

4. the field emission display of claim 1 wherein said first and second images are substantially identical except for the respective first and second brightness modes in which they arc displayed.

5. A field emission display, comprising:

a display screen having a conductive surface;

a cathodoluminescent coating disposed on said inner surface;

an extraction grid disposed a predetermined distance away from said inner surface, said grid having a plurality of openings;

a plurality of emitters each aligned with a corresponding one of said openings, said emitters arranged in sets that each include at least one emitter; and a plurality of emitter drivers each coupled to the emitters in a corresponding one of said sets, each of said drivers connected to receive a control signal having first and second ranges of values, said driver driving said emitters in said corresponding set with a first current within a first range of currents in response to said control signal having a value within said first range of values, said driver driving said emitters in said corresponding set with a second current within a second range of currents in response to said control signal having a value within said second range of values, the gain of said driver when said control signal has a value within said second range of values being significantly greater than the gain of said driver when said control signal has a value within said first range of values.

6. The field emission display of claim 5 wherein:

said first and second ranges of values of said control signal comprise first and second ranges of voltages respectively; and each of said drivers converts said first range of voltages into said first range of currents said second range of voltages into said second range of currents.

7. The field emission display of claim 5 wherein:

said first and second ranges of values of said control signal comprise first and second ranges of voltages respectively; and each of said drivers comprises an impedance element having a nonlinear current-voltage characteristic, and each of said drivers couples a voltage within said first range of voltages and a voltage within said second range of voltages across said impedance element to generate said first and second currents respectively.

8. A field emission display, comprising:

a display screen having a conductive inner surface;

a cathodoluminescent coating disposed on said inner surface;

an extraction grid disposed a predetermined distance away from said inner surface, said grid having a plurality of openings;

a plurality of emitters each aligned with a corresponding one of said openings, said emitters arranged in sets that each include at least one emitter; and a plurality of emitter drivers each coupled to the emitters in a corresponding one of said groups, each of said drivers connected to receive a luminance signal that varies within a first range of voltage values and within a second range of voltage values, each driver having an impedance element that has a nonlinear voltage-current characteristic, each driver coupling said luminance signal across said impedance element to generate an emitter current and driving said corresponding group of said emitters with said emitter current such that when said luminance signal varies within said first range of voltage values, said display screen displays an image in a first brightness mode, and when said luminance signal varies within said second range of voltage values, said display screen displays said image in a second brightness mode.

9. The field emission display of claim 8 wherein:

said voltage values within said first range are on average less than said voltage values within said second range;

said first brightness mode is an image-viewing mode; and said second brightness mode is an image-projection mode in which said display screen displays said image having a greater brightness level than when said display screen displays said image in said image-viewing mode.

10. The field emission display of claim 8 wherein said impedance element comprises two diodes coupled in a back-to-back configuration.

11. The field emission display of claim 8 wherein said impedance element comprises a reverse-biased diode.

12. The field emission display of claim 8 wherein said first range of voltage values overlaps said second range of voltage values.

13. A field emission display, comprising:

a display screen having a conductive inner surface;

a cathodoluminescent coating disposed on said inner surface;

an extraction grid disposed a predetermined distance away from said inner surface, said grid having a plurality of openings;

a plurality of emitters each aligned with a corresponding one of said openings, said emitters arranged in sets that each include one or more emitters that are coupled together at an emitter node; and a plurality of emitter-current generators each coupled to the emitters of an associated one of said sets, each of said emitter-current generators including, a voltage generator having a luminance-signal input terminal, an impedance element coupled to said emitter node and to said voltage generator, said impedance element having a nonlinear current-voltage characteristic, and each of said emitter-current generators operating over a first approximately linear portion of said nonlinear current-voltage characteristic to cause said display screen to display an image in a first brightness mode, each of said emitter-current generators operating over a second approximately linear portion of said nonlinear current-voltage characteristic to cause said display screen to display an image in a second brightness mode, the average slope of said first approximately linear portion significantly different than the average slope of said second approximately linear portion.

14. The display of claim 13 wherein said impedance element comprises a P-type semiconductor region that is disposed between first and second N-type semiconductor regions.

15. The display of claim 13 wherein said impedance element comprises an N-type semiconductor region that is disposed between first and second P-type semiconductor regions.

16. The display of claim 13 wherein said impedance element comprises an N-type semiconductor region that is disposed adjacent to a P-type semiconductor region.

17. The display of claim 13 wherein:

said impedance element includes a first impedance terminal coupled to a reference terminal and includes a second impedance terminal; and said voltage generator includes a transistor having a control terminal coupled to said luminance-signal input terminal, said transistor serially coupled between said emitter node and said second impedance terminal.

18. The display of claim 13 wherein:

said impedance element includes a first impedance terminal coupled to said luminance-signal input terminal and includes a second impedance terminal; and said voltage generator includes an enable terminal and an enable switch having a control terminal coupled to said enable terminal, said switch serially coupled between said emitter node and said second impedance terminal.

19. The display of claim 13 wherein:

said impedance element includes first and second impedance terminals; and said voltage generator includes a transistor having a control terminal and serially coupled between said emitter node and said first impedance terminal, an enable terminal coupled to said second impedance terminal, and a switch having a control terminal coupled to said enable terminal, said switch serially coupled between said luminance-signal input terminal and said control terminal of said transistor.

20. A device for generating and displaying a video image, comprising:

a video processing circuit coupled to receive and process a video signal, and to generate a display signal from said video signal; and a field emission display coupled to receive said display signal and to display said video image, said field emission display including, a display screen having a conductive inner surface, a cathodoluminescent coating disposed on said inner surface, an extraction grid disposed a predetermined distance away from said inner surface, said grid having a plurality of openings, a plurality of emitters each aligned with a corresponding one of said openings, said emitters arranged in sets that each include at least one emitter, and a plurality of emitter drivers each coupled to the emitters in a corresponding one of said sets, each of said drivers connected to receive a control signal having first and second ranges of values, said drivers driving said emitters such that said display screen displays a first image in a first brightness mode when said control signal is within said first range of values, said drivers driving said emitters such that said display screen displays a second image in a second brightness mode when said control signal is within said second range of values, the ratio of the maximum brightness of said first image in said first brightness mode to the maximum brightness of said second image in said second brightness mode being significantly greater than the ratio of the maximum value of said second range of values to the maximum value of said first range of values.

21. The device of claim 20 wherein:

said first and second ranges of values of said control signal respectively comprise first and second ranges of voltages, and each of said drivers converts said first range of voltages into a first range of currents and said second range of voltages into a second range of currents, and each of said drivers drives the emitters in said corresponding group of emitters with said first and second ranges of currents such that when said drivers drive said emitters with a current within said first range of currents, said screen displays said first image in said first brightness mode, and when said drivers drive said emitters with a current within said second range of currents, said screen displays said second image in said second brightness mode.

22. the device of claim 20 wherein each of said drivers comprises a variable gain circuit that causes said each driver to drive said emitters with a current that is a multiple of the intensity of an image signal said multiple being determined by said control signal.

23. The device of claim 20 wherein:

said first and second ranges of values of said control signal respectively comprise first and second ranges of voltages; and each of said drivers comprises an impedance element having a nonlinear current-voltage characteristic, each of said drivers couples said first and second ranges of voltages across said impedance element to generate first and second ranges of currents respectively, and each of said drivers drives the emitters in said corresponding group of emitters with respective currents within said first and second ranges of currents such that when said drivers drive said emitters with a current within said first range of currents, said screen displays said first image in said first brightness mode, and when said drivers drive said emitters with a current within said second range of currents, said screen displays said second image in said second brightness mode.

24. The device of claim 20 wherein said first and second images are substantially identical except for the respective first and second brightness modes in which they are displayed.

25. The device of claim 20, further comprising a tuner operable to receive a plurality of broadcast signals, select one of said broadcast signals, and provide said selected broadcast signal to said video processing circuit as said video signal.

26. The device of claim 20, further comprising an optical assembly that is located a predetermined distance from said field emission display and is operable to allow direct viewing of said video image in a direct-view mode of operation and is operable to allow projecting of said video image in a projection mode of operation.

27. A method for displaying images on a display screen, comprising:

displaying on said display screen a first image having a first average luminance level when an input signal is within a first range of values having a first average value; and displaying on said display screen a second image having a second average luminance level when said input signal is within a second range of values having a second average value, the ratio of said second average luminance level and said second average value significantly greater than the ratio of said first average luminance level and said first average value.

28. The method of claim 27 wherein said displaying said first image and said displaying said second image comprise generating the luminance levels of said first and second images as a nonlinear function of said input signal.

29. The method of claim 27 wherein:

said displaying said first image comprises generating the luminance level of said first image as a first function of said input signal; and said displaying said second image comprises generating the luminance level of said second image as a second function of said input signal.

30. The method of claim 27 wherein:

said displaying said first image comprises (generating said first average luminance level of said first image as a first approximately linear function of said input signal;

said displaying said second image comprises generating said second average luminance level of said second image as a second approximately linear function of said input signal; and the average slope of said first approximately linear function is significantly less than the average slope of said second approximately linear function.

* * * * *

UNITED STATES PATENT AND TRADEMARK OFFICE

CERTIFICATE OF CORRECTION

PATENT NO. : 5,847,515
DATED : December 8, 1998
INVENTOR(S) : Lee et al.

It is certified that error appears in the above-identified patent and that said Letters Patent is hereby corrected as shown below:

Column 6,
Line 20, "$Y_1$" should read -- Y1 --

Column 7,
Line 42, "100pA per" should read -- 100pA per pixel, which gives --
Line 60, "fiel-doxide" should read -- field-oxide --

Column 8,
Line 65, "amplifier 122" should read -- amplifier 24 --

Column 10,
Line 35, "the" should read -- The --
Line 53, "the" should read -- The --

Column 13,
Line 61, "the" should read -- The --

Column 14,
Line 56, "comprises (generating" should read -- comprises generating --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*